United States Patent [19]

Theurer et al.

[11] 4,312,275

[45] Jan. 26, 1982

[54] IMMERSION DEPTH CONTROL FOR BALLAST TAMPING TOOLS

[75] Inventors: Josef Theurer, Vienna; Gernot Böck, Aschach; Mihir Ganguly, Linz, all of Austria

[73] Assignee: Franz Plasser Bahnbaumaschinen-Industriegesellschaft m.b.H., Vienna, Austria

[21] Appl. No.: 115,505

[22] Filed: Jan. 25, 1980

[30] Foreign Application Priority Data

Feb. 26, 1979 [AT] Austria ..... 1470/79

[51] Int. Cl.[3] ..... E01B 27/17

[52] U.S. Cl. ..... 104/12; 104/7 R

[58] Field of Search ..... 104/7 R, 7 B, 12; 172/2

[56] References Cited

U.S. PATENT DOCUMENTS

| | | | |
|---|---|---|---|
| 2,876,709 | 3/1959 | Plasser et al. | 104/12 |
| 3,127,848 | 4/1964 | Plasser et al. | 104/12 |
| 3,177,813 | 4/1965 | Stewart | 104/12 |
| 3,762,333 | 10/1973 | Theurer et al. | 104/12 |
| 3,910,195 | 10/1975 | Theurer | 104/12 |
| 3,949,678 | 4/1976 | Theurer | 104/12 |
| 4,010,692 | 3/1977 | Goel | 104/12 |

FOREIGN PATENT DOCUMENTS

| | | | |
|---|---|---|---|
| 290599 | 6/1971 | Austria | 104/7 B |
| 614475 | 11/1979 | Switzerland | 104/12 |
| 731580 | 6/1955 | United Kingdom | 104/12 |
| 1185986 | 4/1970 | United Kingdom . | |

*Primary Examiner*—Randolph A. Reese
*Attorney, Agent, or Firm*—Kurt Kelman

[57] ABSTRACT

A control arrangement for operating the hydraulic drive and for monitoring the vertical movement and a corresponding immersion depth of the tamping tools in the ballast of a tamping unit includes a hydraulic fluid control circuit connected to the hydraulic drive for the unit, a control valve in the control circuit, the valve being capable of steplessly adjusting hydraulic fluid flow to the drive, and a control connected to the valve for adjustment thereof. The control has a first signal transmitter providing a control signal indicating the actual vertical position of the tamping unit and a second signal transmitter providing another control signal indicating a desired immersion depth of the tamping tools in the ballast.

6 Claims, 3 Drawing Figures

Figure 3:
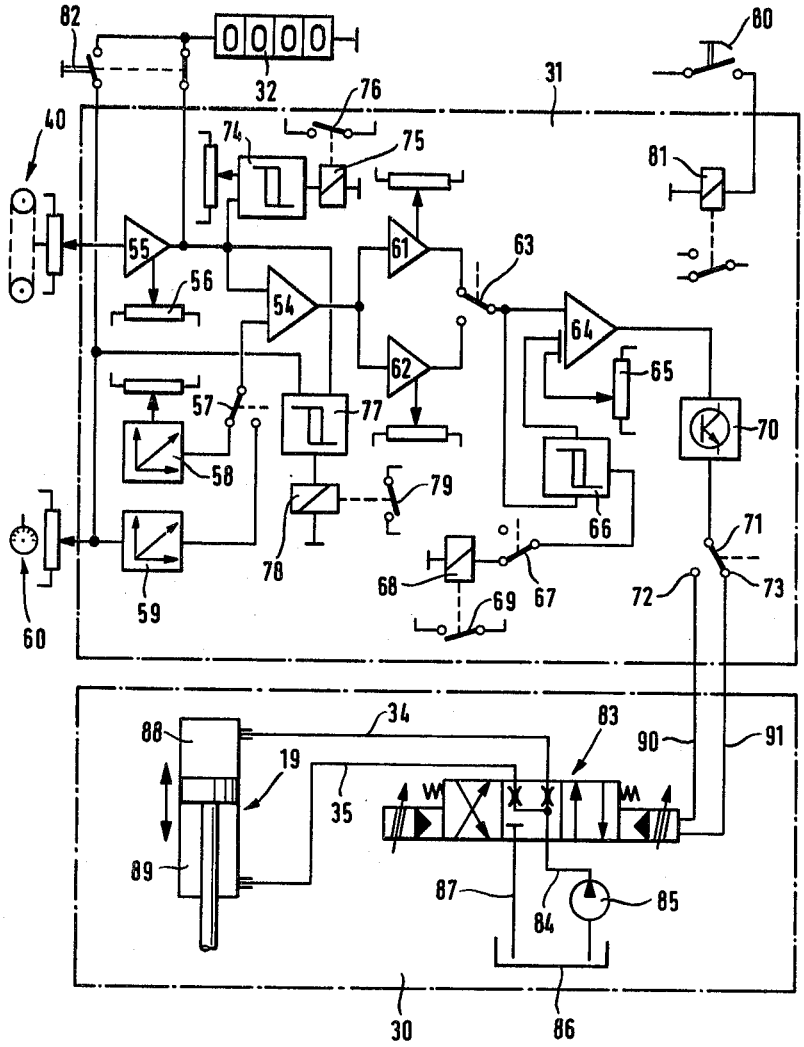

Fig. 1
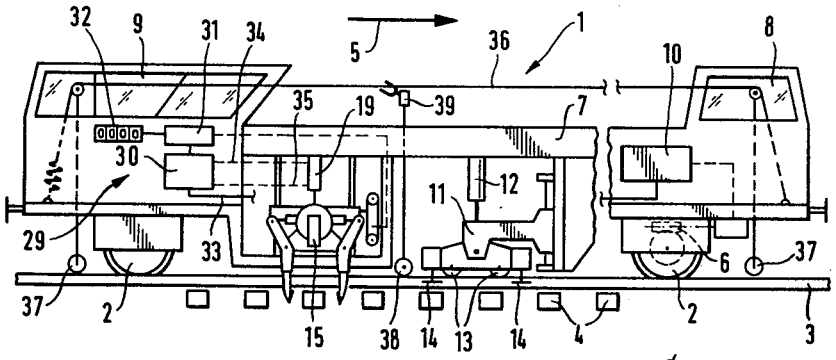
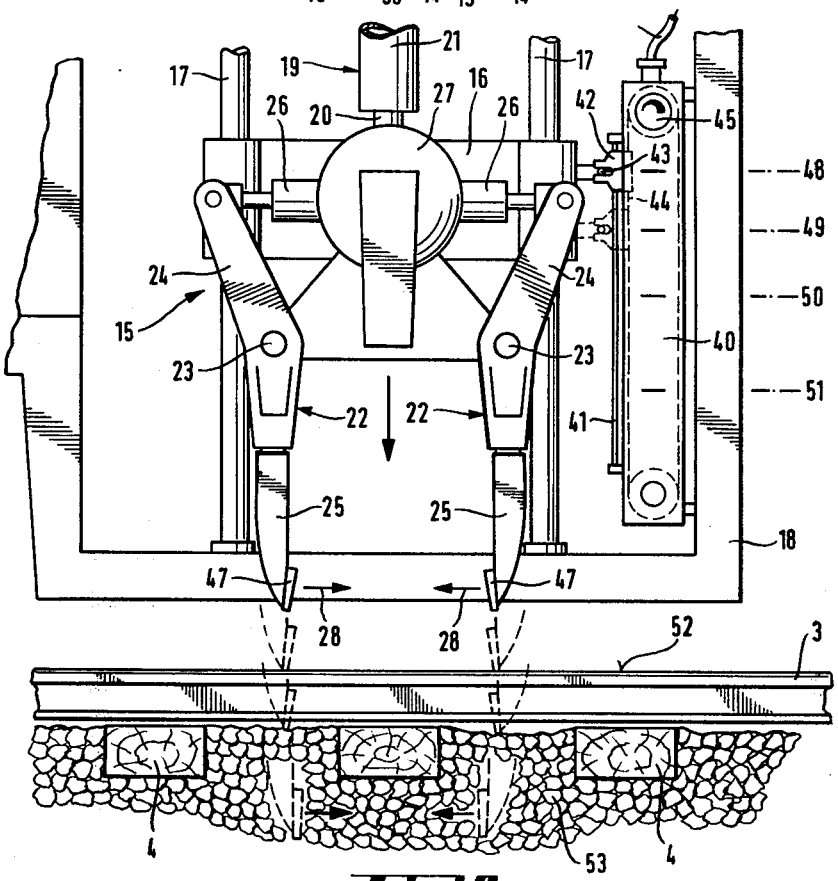
Fig. 2

IMMERSION DEPTH CONTROL FOR BALLAST TAMPING TOOLS

The present invention relates to a control arrangement in a tamping machine mounted for mobility on track rails fastened to ties supported on ballast. The mobile tamping machine comprises a machine frame, a tamping unit vertically movable mounted on the machine frame and including reciprocable and vibratory tamping tools immersible in the ballast upon vertical movement of the tamping unit and operable to tamp ballast under respective ties on reciprocation and vibration of the tamping tools, and a hydraulic drive for vertically moving the tamping unit, the hydraulic drive connecting the tamping unit to the machine. Tamping machines of this type are well known and the control arrangement of this invention is designed for operating the hydraulic drive and for monitoring the vertical movement and a corresponding immersion depth of the tamping tools in the ballast.

U.S. Pat. No. 2,876,709, dated Mar. 10, 1959, discloses such a tamping machine with adjustable support means for the tamping unit to delimit the immersion depth of the tamping tools. The support means may be a pressure fluid operated cylinder-piston device which may be remote-controlled from an operator's cab to enable the immersion depth of the tamping tools to be changed to adapt to local track conditions.

In the mobile ballast tamping machine of British Pat. No. 731,580, published June 8, 1955, the immersion depth of the tamping tools is variably adjusted by a threaded spindle-and-nut device cooperating with blocks of different heights. This mechanical adjustment has many disadvantages. The threaded spindle is subjected to heavy stresses on sudden impact of the rapidly descending tamping unit of heavy mass against the block delimiting the downward stroke and there is no possibility of continuously adjusting the immersion depth during operation. The mechanism wears rapidly, causing frequent operating breakdowns.

The mobile track tamping machine of U.S. Pat. No. 3,127,848, dated Apr. 7, 1964, provides various operating controls for the functions of the machine, including a control for delimiting the vertical movement of the tamping unit.

Austrian Pat. No. 290,599, published Oct. 15, 1970, discloses a device for monitoring the corrected position of a track in a mobile tamping, leveling and lining machine. This device comprises a rotary potentiometer for determining the relative position of a reference wire to a measuring buggy, the potentiometer being connected to an endless cable line or tackle extending transversely to the reference wire and moving therewith. Such rotary potentiometer-tackle devices have also been used in mobile track tampers in a vertical position for controlling or monitoring the vertical movement of the tamping tool carrier and the tamping tools supported thereon.

Experience has shown that a fully adequate control of the vertical movement of the tamping unit and the immersion of the tamping tools in the ballast to obtain the desired immersion depth accurately has been impossible with the known control arrangements. An optimal control requires not only that a number of operating and control requirements, which at times contradict each other, are taken into account but that the control be also responsive to the influence of the local ballast conditions, which sometimes vary greatly, on the tamping operation. Such an optimal control should meet the following working and operating requirements:

It should enable an operator simply and effectively to preselect any desired maximum immersion depth of the tamping tools by remote control from his cab.

The descent of the tamping tool unit from its upper rest to its immersion position should proceed rapidly but smoothly.

The descending tamping unit should then be accelerated to a rather high speed to enable the ballast tamping tools to penetrate into the ballast with high energy.

The subsequent movement of the immersed tamping tools to the desired immersion depth should take as little time as possible but should proceed with gradual deceleration to avoid sudden impacts on the machine frame when the tamping unit is stopped at the preselected vertical position.

Most of all, the control should assure the utmost accuracy in holding the immersion depth to the preselected value, independent of the local ballast bed conditions and other operating variables, such as the viscosity of the hydraulic fluid medium used for the operation of the drives.

It is, therefore the primary object of the invention to provide a control arrangement in a mobile tamping machine, which meets the above requirements as fully as possible.

The present invention accomplishes this object with a control arrangement including a hydraulic fluid control circuit connected to the hydraulic drive, a control valve in the control circuit which is capable of steplessly adjusting hydraulic fluid flow to the drive, and a control connected to the valve for adjustment thereof, the control having a first signal transmitter providing a control signal indicating the actual vertical position of the tamping unit and a second signal transmitter providing another control signal indicating a desired immersion depth of the tamping tools in the ballast.

This control arrangement makes it possible in an unexpectedly simple manner to obtain a control signal derived from a constant comparison between the signal indicating the actual vertical position of the tamping unit and the other signal indicating a desired immersion depth, which control signal may be modulated within the control arrangement by additional input signals indicating a desired characteristic of the vertical movement, such as the descent of the tamping unit, and which is used directly to operate the steplessly adjustable control valve.

In contrast to the conventional shut-off valves mounted in the hydraulic control circuit for the hydraulic drive of the tamping unit, which have only an open and closed position whereby the vertical movement is stopped or started abruptly upon operation of the valve, a steplessly adjustable control valve may be given any desired control characteristic, such as an increasing delay or damping of the downward movement of the tamping unit from the moment the tamping tools touch the ballast before immersion to the pre-selected immersion depth of the tamping tools in the ballast. This control of the last phase of the descent of the tamping unit makes it possible for the first time to obtain an impact-free stoppage of the tamping unit with an accuracy of millimeters at the pre-selected maximal immersion depth, i.e. at the moment when the signals indicating the actual vertical position and the desired immersion depth coincide.

Since the control of the velocity of the vertical movement in both directions is obtained by adjusting the hydraulic fluid flow through the control valve and the hydraulic pressure effectively exerted upon the drive remains practically unchanged at its full strength over the entire range of the movement, the full force of the hydraulic drive remains available from the beginning to the end of the movement, in addition to the weight and mass forces of the tamping unit. This means that different ballast conditions, such as encrusted or loose ballast, deep or shallow ballast beds, more or less dirt in the ballast, different ballast sizes, uneven ballast distribution and the like, have practically no bearing on the most decisive phase of the downward movement of the tamping unit, which is the immersion of the tamping tools in the ballast and the impact-free stoppage of the downward movement when the desired immersion depth has been reached. This assures a continuity in the tamping quality over long track sections, particularly with respect to the desired depth of the tamping.

In addition, this control arrangement makes it possible to pre-select a desirable optimal velocity change for the vertical movement of the tamping unit in either direction, i.e. to select the acceleration at the beginning of the movement and the deceleration at the end thereof so that the movement is damped to avoid undue impacts on the machine frame.

The above and other object, advantages and features of this invention will become more apparent from the following detailed description of a now preferred embodiment thereof, taken in conjunction with the accompanying generally schematic drawing wherein FIG. 1 is a side elevational view of a mobile tamping, leveling and lining machine incorporating the control arrangement of the invention, FIG. 2 is an enlarged side elevational view of the tamping unit of this machine, with an indication of its different vertical positions, and FIG. 3 is a simplified and schematic circuit diagram of the electronic control circuit and the hydraulic fluid control circuit of the control arrangement.

Referring now to the drawing and first to FIGS. 1 and 2, there is shown a generally conventional tamping, leveling and lining machine 1 mounted for mobility on track rails 3 fastened to ties 4 supported on ballast 53. Machine 1 comprises machine frame 7 supported on the track by single-axle undercarriages 2, 2 for movement along the track in an operating direction indicated by arrow 5, front undercarriage 2 incorporating drive 6 for driving the wheels of the undercarriage. Respective operator's cabs 8 and 9 are mounted on the front and rear ends of machine frame 7. Power plant 10, which includes hydraulic fluid sump 86 and constant-speed hydraulic fluid pump 85 (see FIG. 3), is arranged in the front portion of machine 1.

As is conventional in track leveling and lining machines, machine 1 has track leveling and lining means comprising track lifting and lining unit 11 which is mounted on machine frame 7 by means of hydraulic motor 12 for vertically moving the unit in relation to the frame, another hydraulic motor (not shown) connecting the unit to the machine frame for laterally moving the unit in relation to the frame. This generally conventional track lifting and lining unit has a frame supporting a pair of flanged lining rollers 13, 13 rollingly engaging each track rail 3 and a pair of flanged lifting rollers 14, 14 whose flanges subtend the rail head and rollingly engage the same. In a generally known manner, the track leveling and lining means comprises tensioned reference wire 36 whose ends are supported on rail position sensing elements 37, 37 and another rail position sensing element 38 at the track correction point intermediate the reference wire ends supports track position monitoring device 39, which may be a rotary potentiometer, for producing a track position control signal operating motor 12 for lifting the track rails to a level determined by reference wire 36. Another reference system (not shown) similarly controls the operation of the lining motor in a known manner.

Machine 1 further comprises a tamping unit 15 associated with each rail 3 and vertically movably mounted on machine frame 7. Each tamping unit includes pairs of reciprocable and vibratory tamping tools immersible in ballast 53 upon vertical movement of the tamping unit and operable to tamp ballast under respective ties 4 on reciprocation and vibration of the tamping tools. Hydraulic drive 19 connects tamping unit 15 to machine frame 7 and vertically moves the tamping unit. In the well known embodiment illustrated herein, tamping unit 15 comprises tamping tool carrier 16 vertically glidably mounted on two vertical guide columns 17, 17 which are affixed to auxiliary frame 18 which is rigidly supported on machine frame 7. Hydraulic drive 19 is a double-acting jack comprising cylinder 21 linked to machine frame 7 and a reciprocable piston in the cylinder and dividing the cylinder into two chambers, piston rod 20 attached to the piston and projecting from one end of the cylinder being linked to tamping tool carrier 16. The tamping tool carrier supports pairs of tamping implements 22 each comprised of a tool holder 24 and a tamping tool 25 replaceably mounted in the tool holder. The tamping tools have ballast engaging jaws 47. As shown, pivots 23 extending transversely to the track support the tamping tool holders on carrier 16. Reciprocating drives 26 are linked to the upper ends of the tamping implements to pivot the holders about pivots 23 and thus to reciprocate the tamping tools of each pair towards each other for tamping ballast under each tie at its intersection with rail 3. Furthermore, central vibrating drive 27 is associated with the reciprocating drives for vibrating the tamping tools while they are reciprocated.

All of the above-described structure and its ensuing operation are well known in mobile tamping machines.

Control arrangement 29 for operating hydraulic drive 19 and for monitoring the vertical movement and a corresponding immersion depth of the tamping tools in ballast 53 is mounted in rear operator's cab 9. This arrangement, in essence, includes hydraulic fluid control circuit 30 connected to hydraulic drive 19, control valve 83 in control circuit 30 and control 31 connected to valve 83 for adjustment thereof, the control having first signal transmitter 40 providing a continuous control signal indicating respective vertical positions of tamping unit 15 over the entire range of the vertical movement thereof and second signal transmitter 60 providing another control signal indicating desired immersion depths of the tamping tools in the ballast, as shown in FIG. 3 and to be described in detail hereinafter. Hydraulic circuit 30 receives hydraulic fluid from power plant 10 through hydraulic fluid delivery line 33 (see FIG. 1) and, to simplify the illustration, only hydraulic fluid supply lines 34 and 35 to chambers 88 and 89 of cylinder 21 of the hydraulic drive are shown, the other hydraulic fluid supply lines to the various motors mentioned hereinabove being omitted since these arrangements form no part of the invention.

First signal transmitter 40, which monitors the actual vertical position of tamping unit 15 and provides a control signal indicative thereof, is a rotary potentiometer set by an endless cable line or tackle in the illustrated embodiment, a preferred device being shown in FIG. 2. As illustrated, signal transmitter 40 comprises a support frame affixed to auxiliary frame 18 adjacent tamping unit 15. The support frame carries vertical guide rod 41 glidably supporting slide 42. The slide has a slot engaged by entrainment element or dog 43 which is affixed to tamping tool carrier 16. Thus, the slide vertically moves continuously with the tamping tool carrier as tamping unit 15 moves vertically between uppermost or rest position 48, intermediate positions 49, 50 and lowermost position 51 which constitutes the desired immersion depth of tamping tools 25 in ballast 53. Slide 42 extends into the interior of signal transmitter 40 and is connected to endless cable line 44 which is trained over a lower pulley and rotary potentiometer 45. Thus, the vertical movement of slide 42 in response to the vertical movement of tamping unit 15 causes cable line 44 to rotate potentiometer 45 providing at the output of the potentiometer a continuous control signal indicating the actual vertical position of the tamping unit. This control signal is transmitted to control 31 by conductor 46.

FIG. 2 shows tamping unit 15 and slide 42 of signal transmitter 40 in their uppermost or rest position in full lines. Three additional levels are shown by chain-dotted lines at 49, 50 and 51, the corresponding vertical positions of tamping jaws 47 being illustrated in broken lines, the support frame of transmitter 40 carrying horizontal markers corresponding to the illustrated levels to provide a better understanding. Position 49, at which slide 42 is also shown in broken lines by way of example, corresponds to the vertical position in which the lower edge of tamping jaw 47 is level with running surface 52 of rail 3. Position 50 corresponds to the vertical position in which the lower edge of tamping jaw 47 touches ballast 53, i.e. when the immersion of the tamping tools in the ballast begins, and position 51 corresponds to a pre-selected immersion depth of tamping tools 25 in the ballast. Each of these positions generates a specific output signal of potentiometer 45, which constitutes one of the control signals of control arrangement 29 of the present invention. This control signal is used in control 31 to control the vertical movement, particularly the descent, of tamping unit 15 in a manner which will become more apparent from FIG. 3.

As will be apparent from the above description, signal transmitter 40 is capable of providing a continuous control signal indicative of respective vertical positions of the tamping unit over the entire range of the vertical movement thereof. The control 31 illustrated in FIG. 3 is an electronic comparator circuit comparing the control signal delivered thereto by conductor 46 with the other control signal provided by second signal transmitter 60.

With this preferred embodiment, the vertical position of the tamping unit in relation to the machine frame and the pre-selected immersion depth of the tamping tools provide proper control signals over the entire range of the vertical movement of the tamping unit to provide a control for the continuous regulation of the hydraulic fluid flow through the control valve to the hydraulic drive, which correspondingly regulates the velocity of the vertical movement of the tamping unit, but which may also be used to control other operations, such as the lateral and vertical movement of the track for lining and leveling, the beginning of the tamping and the intermittent forward movement of the machine. Therefore, it is possible to dispense with the cams or stops mounted heretofore on the tamping tool carrier for actuating control or limit switches which determine these other operations in conventional tampers. In this embodiment of the invention, these switch positions are substituted by a corresponding value of the control signal. Thus, these other operations are all electronically controlled by respective switching elements, such as Schmitt triggers, responsive to the corresponding value of the control signal from control 31. This provides an increased operating dependability since electronic switching elements in the protected control panel in the operator's cab replace limit switches on the machine, which are exposed to the weather and other ambient conditions. In addition, the operating level of these electronic switching elements and the corresponding vertical position of the tamping unit, at which the other operations are to be performed, can be readily varied by the operator at the control panel.

As appears from FIG. 3, the illustrated hydraulic drive 19 is a double-acting jack comprising a cylinder and a reciprocable piston in the cylinder dividing the cylinder into two chambers 88 and 89. Control valve 83 is a proportional solenoid valve controlled by electromagnetic means and having outputs respectively connected by lines 34 and 35 to the cylinder chambers for delivering hydraulic fluid thereto. The electromagnetic means selectively control the flow of hydraulic fluid to a respective cylinder chamber by their selective connection to control outputs 72 and 73 of control 31. This arrangement takes full advantage of the control advantages of proportional valves for a precise control of the vertical movement of a tamping unit, particularly the immersion of its tamping tools in the ballast and the exact limitation of this movement to a pre-selected immersion depth. A very useful control valve is a four-way-proportional valve of the type WRZ 25 E, sold by Rexroth.

Proportional valves are comprised essentially of a pre-control valve constituted by a pressure control valve operated by direct current solenoids and a main valve controlled thereby and constituted by a fluid flow control valve which has a piston held in a centered rest position by centering springs, the piston being moved by the pre-control valve to direct the hydraulic fluid flow to the hydraulic fluid drive cylinder chambers connected to the fluid flow control valve. The characteristic of such proportional valve is such that the exciting current for the direct current magnets is proportional to the hydraulic fluid flow through the main valve within the operating range. In this way, the amplified control signal from control 31 can be used directly for the continuous control of the amount of hydraulic fluid delivered to a respective cylinder chamber 88, 89 between zero and a maximal amount. This hydraulic fluid delivery may be throttled to a minimum shortly before one of the two vertical end positions of the tamping unit has been reached so that the de-energization of the respective magnet at the moment the desired position has been reached will immediately interrupt any further flow of hydraulic fluid to the respective cylinder chamber of hydraulic drive 19. This will cause the tamping unit to be very precisely stopped in the selected end position.

Preferred control 31 shown in FIG. 3 comprises first sum-and-difference amplifier 54 having a first input connected to first signal transmitter 40 and receiving the control signal therefrom, and a second input connected to second signal transmitter 60 and receiving the other control signal therefrom. Timing circuit 59 is connected between the second signal transmitter and the second input of sum-and-difference amplifier 54. A second sum-and-difference amplifier 64 has a first input connected to the output of first sum-and-difference amplifier 54, amplifier means 61, 62 consisting of adjustable amplifiers being connected between the output of the first sum-and-difference amplifier and the first input of the second sum-and-difference amplifier. Second sum-and-difference amplifier 64 has a second input connected to source 65 of an adjustable comparator signal, the second input receiving the comparator signal from the source thereof. The illustrated source of an adjustable comparator signal is a voltage divider. Output stage 70 is connected to the output of second sum-and-difference amplifier 64 and has an output connectable selectively to the electromagnetic means operating valve 83.

As shown in the drawing, the control signal from first signal transmitter 40 is amplified by amplifier 55 with zero setting element 56, the amplifier being connected between the first signal transmitter and the first input of sum-and-difference amplifier 54. Second signal transmitter 60 is pre-set and continuously adjustable to emit another control signal indicating a desired immersion depth of the tamping tools and is selectively connectable to the second input of sum-and-difference amplifier 54 by throw-over switch 57. The switch may be operated to disconnect second signal transmitter 60 and to connect sum-and-difference amplifier 54 to timing circuit 58. Timing circuit 58 is set or adjusted by the lifting stroke of the tamping unit while timing circuit 59 is set or adjusted by the descending movement of the tamping unit. The output of sum-and-difference amplifier 54 is connected to amplifier 61 which is set or adjusted by the lifting stroke and to amplifier 62 which is set or adjusted by the descending movement, throw-over switch 63 connecting the first input of second sum-and-difference amplifier 64 selectively to one of amplifiers 61 or 62. Zero switch 66 is connected parallel to the inputs of sum-and-difference amplifier 64 and this switch actuates relay 68 with switching contact 69, throw-over switch 67 being connected between switch 66 and relay 68. The zero switch is arranged to disconnect the output of output stage 70 from the electromagnetic means of valve 83 to de-energize the electromagnetic means when the control signals from first and second signal transmitters 40 and 60 coincide. Throw-over switch 71 enables the output stage to be selectively connected with one of outputs 72 or 73 of control 31 for delivering the control signal thereof to one of the two electromagnets of proportional valve 83.

This relatively simple electronic control circuit makes it possible, at the beginning of the descending movement of the tamping unit, to supply a pre-set control signal which is to be compared to the control signal indicating the actual tamping unit position not spontaneously but increasing after a set timing function. Therefore, at the onset of the tamping operation, a control signal of gradually increasing voltage is produced at the output of sum-and-difference amplifier 54, correspondingly controlling proportional valve 83 until it has gradually reached its maximum fluid throughput capacity. This causes the tamping tools to be lowered in a movement which starts slowly and reaches a desired high velocity during the immersion of the tamping tools in the ballast. The pre-set comparison signal will then so control valve 83, beginning at a set immersion depth of, for example, 120 mm above the desired maximum depth, that the hydraulic fluid throughput to drive 19 will gradually reach its maximum value. As soon as the two control signals from transmitters 40 and 60 coincide, the electromagnetic means will be de-energized abruptly, closing the valve and stopping the vertical movement of the tamping unit. The zero switch assures the accurate and immediate closing of the valve when the pre-set immersion depth has been reached, the centering springs built into the valve assuring its closure when the electromagnetic means is de-energized. The zero switch thus assumes the function of a limit switch preventing an further downward movement of the tamping unit beyond the set immersion depth.

For most effective operation, control 31 comprises further switching elements for automating various operational stages, for instance track leveling and lining movements as well as the start of the tamping operation. In the illustrated embodiment, control 31 includes as control switch for the leveling and lining operation a Schmitt trigger 74 whose level of response may be adjusted and whose input is connected to first signal transmitter 40, receiving the amplified control signal therefrom via amplifier 55. Schmitt trigger 74 controls relay 75 whose contact 76 is connected in the control circuit of lifting and lining unit 11.

Further Schmitt trigger 77 serves as a control switch for starting the tamping operation. One of the inputs of Schmitt trigger 77 is also connected to first signal transmitter 40 and receives the amplified control signal therefrom via amplifier 55 while a second input of this Schmitt trigger is connected directly to second signal transmitter 60 to receive the other control signal therefrom. Schmitt trigger 77 controls relay 78 whose contact 79 is connected in the control circuit for reciprocating drive 26 of tamping tools 22.

In the circuit diagram of FIG. 3, all throw-over switches 57, 63, 67 and 71 are shown in the position for raising tamping unit 15. Foot pedal 80 is mounted in the operator's cab to enable the operator to energize main relay 81 connected to all the throw-over switches, as shown diagrammatically in broken lines, for moving the switches into the other operating position for lowering the tamping unit.

As also illustrated in FIG. 3, the preferred control further comprises indicator device 32 selectively connectable by selection switch 82 to the first and second signal transmitters, the amplified control signal from transmitter 40 reaching the indicator device through amplifier 55 while the other control signal is transmitted to the indicator device directly from transmitter 60. The illustrated indicator device is a digital indicator and the actual zero indication is preferably set by means of zero setting element 56 to indicate a marked vertical position of the tamping unit, for instance position 49 wherein the tamping jaws touch the running surfaces of the rails. This gives the operator at all times the possibility to control not only the pre-set desired immersion depth but also the actual position of the tamping unit in relation to the level indicated by the zero setting.

Hydraulic control circuit 30 is shown in simplified form in FIG. 3. It includes essentially 4-way proportional solenoid valve 83 connected to hydraulic input line 84 which receives a flow of hydraulic fluid under constant pressure from the output of pump 85 delivering the fluid from hydraulic fluid sump 86. Hydraulic fluid return line 87 leads from the valve back to the sump, and fluid delivery lines 34 and 35 connect the output of the valve to cylinder chambers 88 and 89 of hydraulic drive 19. We have found Rexroth's 4-way proportional valve "4 WRZ 25 E" useful, this valve having a nominal throughput of 240 1/minute and a nominal current range of 240–270 mA. The two electromagnets controlling the flow of hydraulic fluid to cylinder chambers 88 and 89 through valve 83 are not shown, except for the diagrammatic indication of their connections 90 and 91 to outputs 72 and 73 of control 31.

The operation of the above-described apparatus will partly be clear from the description of its structure and will now be set forth in additional detail, step by step.

(1) Preparation for Lowering Tamping Unit 15

Referring to FIG. 2, the tamping unit is in uppermost position 48. Second signal transmitter 60 is set to produce a control signal indicative of the desired immersion depth, which is lower-most position 51. Setting element 56 is operated to produce a zero setting for the control signal from first signal transmitter 40 indicative of a given level, for example position 49. Vertical positions above that level appear on digital indicator 32 as positive values while vertical positions below the set level appear on the indicator as negative values. Schmitt triggers 74 and 77 are adjusted to respond to the desired values, i.e. the respective vertical positions of tamping unit 15 whereat it is desired to start the lining and leveling operation, on the one hand, and the tamping operation, on the other hand. Furthermore, a comparison signal is delivered by voltage divider 65 to second sum-and-difference amplifier 64, this comparison signal being of such strength that the amplified output signal of amplifier 64 appearing at the output of stage 70 is just strong enough to energize the electromagnet controlling valve 83 for the lowering of the tamping unit so that a minimal hydraulic fluid flow is provided to upper cylinder chamber 88 of hydraulic drive 19.

(2) Soft Start for the Lowering of the Tamping Unit

The operator now depresses foot pedal 80 to throw switches 57, 63, 67 and 71 into their positions for the descending movement of the tamping unit. At the same time, the control signal indicating the actual vertical position of the tamping unit and the other control signal indicating the desired immersion depth, which are delivered to control 31 from transmitters 40 and 60, respectively, are compared in the control. However, the other control signal from second signal transmitter 60 is not delivered immediately at full strength to the second input of sum-and-difference amplifier 54 but is supplied thereto with gradually increasing strength through timing circuit 59 whose timing function has been pre-set. An increasing voltage difference appears between the control signal indicating the actual position and the other control signal indicating the desired immersion depth, and the resultant output signal from sum-and-difference amplifier 54 is amplified in amplifier 62, the amplified signal being transmitted therefrom to second sum-and-difference amplifier 64 which transmits the signal to output stage 70 whose output 72 is connected to line 90 for energizing the electromagnetic controlling valve 83 for lowering the tamping unit with increasing power. This causes a gradually increasing hydraulic fluid flow into upper cylinder chamber 88 so that tamping unit 15 descends with increasing velocity. As soon as the difference between the control signal indicating the actual vertical position of the tamping unit and the other control signal indicating the desired immersion depth of the tamping tools has reached a maximum value, the proportional valve is opened to is fullest, producing a maximum hydraulic fluid flow into cylinder chamber 88 and a corresponding maximum speed of downward movement of the tamping unit.

(3) Leveling and Lining of the Track

As soon as the voltage difference between the control signal indicating the actual vertical position of the tamping unit and the other control signal indicating the desired immersion depth of the tamping tools exceeds the level of response set for Schmitt trigger 74, relay 75 is energized and switching contact 76 is closed. This causes the control circuit for lifting and lining unit 11 to be energized and the track is leveled and lined immediately ahead of tamping unit 15 in a manner which is well known and forms no part of the present invention.

Meanwhile, tamping unit 15 has passed from uppermost position 48 through zero position 49 and has reached position 50 in which the immersion of tamping tools 25 in ballast 53 starts.

(4) Tamping Tool Immersion and Damping of Tamping Unit Movement

When a predetermined lowered position is reached, for example about 120 mm above the desired immersion depth set at second signal transmitter 60, the throughput of valve 83 is controlled for the remainder of the downward stroke to decrease gradually from a maximum value to a minimum value corresponding to the comparison signal fed by voltage divider 65 to sum-and-difference amplifier 64, as explained hereinabove. Therefore, the flow of hydraulic fluid from valve 83 through line 34 into upper cylinder chamber 88 decreases gradually to a minimum, thus slowing the descent of the tamping unit. At the moment the control signals from transmitters 40 and 60 coincide, i.e. their difference is zero, zero switch 66 responds and disconnects the control current from valve 83. This causes the valve to disrupt further hydraulic fluid flow to cylinder chamber 88 and the tamping unit is stopped without sudden impact or jolt within a range of a few millimeters at set immersion depth 51.

(5) Start of the Tamping Operation

As soon as the difference between the control signal indicating the actual vertical position of the tamping unit and the other control signal indicating the desired immersion depth of the tamping tools exceeds the voltage level of response set for Schmitt trigger 77, relay 78 is energized and switching contact 79 is closed. This causes the control circuit for reciprocating drive 26 of tamping tools 25 to be energized to squeeze the tamping tools together. If the response level of Schmitt trigger 77 is adjustable, the start of the squeezing motion may be set to begin in a vertical position of the tamping unit a few centimeters above position 51, as has been indicated for the lowest position of tamping tools 25 in FIG. 2. This enables the tamping tools to penetrate through very encrusted ballast to the pre-set immersion depth without substantial loss of time.

(6) Return of the Tamping Unit to its Rest Position

By releasing foot pedal 80 or by automatic command to switch to raising of tamping unit 15, throw-over switches 57, 63, 67 and 71 are reset to the "lifting" positions illustrated in FIG. 3. A pre-set control signal of gradually increasing voltage is supplied by timing circuit 58 to the second input of sum-and-difference amplifier 54 so that the upward movement of the tamping units starts off slowly from position 51. Control 31 may include additional switching means similar to Schmitt triggers 74 and 77 for causing machine 1 to advance in operating direction 5 to the succeeding tamping station as soon as tamping unit 15 has reached a predetermined vertical position above the track. Analogously to the descending movement, the upward movement of tamping unit 15 is damped before it reaches uppermost position 48, thus assuring stoppage of the tamping unit at that position without impact or jolt.

During the entire operation, the position of tamping unit 15 may be continuously observed by watching digital indicator 32.

If desired, control 31 may also include additional relays to provide the operator of machine 1 with information "tamping unit up", "tamping unit intermediate" and "tamping unit down", thus replacing the conventional limit switches used on mobile tampers.

While a useful electronic comparator circuit serving as control 31 has been illustrated and described herein, it will be obvious to those skilled in the art that other types of equivalent controls may be used for operating a proportional hydraulic fluid flow control valve or a valve arrangement equivalent thereto. Furthermore, the control arrangement of the present invention is not limited to single-tie tampers but may be particularly useful in various special types of tampers designed for tamping several ties simultaneously and/or for tamping track switches and crossings. Obviously, the type of signal transmitters used to deliver the control signals to control 31 may also vary widely.

What is claimed is:

1. In a tamping machine mounted for mobility on track rails fastened to ties supported on ballast, which comprises a machine frame, a tamping unit vertically movably mounted on the machine frame and including reciprocable and vibratory tamping tools immersible in the ballast upon vertical movement of the tamping unit and operable to tamp ballast under respective ones of the ties on reciprocation and vibration of the tamping tools, and a hydraulic drive for vertically moving the tamping unit, the hydraulic drive connecting the tamping unit to the machine frame: an automatic control arrangement for operating the hydraulic drive and for monitoring the vertical movement and a corresponding immersion depth of the tamping tools in the ballast, the control arrangement including (a) a hydraulic fluid conduit circuit connected to the hydraulic drive, (b) a control valve in the control circuit, the valve being capable of steplessly adjusting hydraulic fluid flow to the drive, and (c) a control for regulating the velocity of the vertical movement in dependence on the vertical position of the tamping unit, the control having an input and an output connected to the valve for adjustment thereof, (1) a first signal transmitter providing a continuous control signal indicating respective vertical positions of the tamping unit over the entire range of the vertical movement thereof and (2) a continuously adjustable second signal transmitter providing another control signal indicating desired immersion depths of the tamping tools in the ballast whereby the hydraulic fluid flow and the corresponding vertical movement velocity is regulated by a control signal derived from the signals of the first and second signal transmitters.

2. The tamping machine of claim 1, wherein the first signal transmitter comprises a rotary potentiometer providing an output signal constituting the control signal.

3. The tamping machine of claim 1, wherein the control is an electronic comparator circuit comparing the control signal provided by the first signal transmitter with the other control signal provided by the second signal transmitter.

4. The tamping machine of claim 1 or 3, wherein the hydraulic drive is a double-acting jack comprising a cylinder and a reciprocable piston in the cylinder dividing the cylinder into two chambers, the control valve is a proportional solenoid valve controlled by two electromagnets and having outputs respectively connected to the cylinder chambers for delivering hydraulic fluid thereto, and the control output having two output leads respectively connected to the electromagnets and a switch selectively energizing one of the output leads for receiving and transmitting the control signal to a respective one of the electromagnets for selectively controlling the flow of hydraulic fluid to a respective one of the cylinder chambers whereby the tamping unit is raised or lowered.

5. The tamping machine of claim 4, wherein the electronic comparator circuit comprises a first sum-and-difference amplifier, the amplifier having an output, a first input connected to the first signal transmitter and receiving the control signal therefrom, and a second input connected to the second signal transmitter and receiving the other control signal therefrom, a timing circuit connected between the second signal transmitter and the second input of the sum-and-difference amplifier, a second sum-and-difference amplifier, the second amplifier having an output, a first input connected to the output of the first amplifier and a second input, amplifier means connected between the output of the first amplifier and the first input of the second amplifier, a source of an adjustable comparator signal connected to the second input of the second amplifier, the second input receiving the comparator signal from the source thereof, and an output stage connected to the output of the second amplifier, the output stage having an output connected to the switch.

6. The tamping machine of claim 5, further comprising an electronic zero switch associated with the second sum-and-difference amplifier and arranged to disconnect the output of the output stage from the electromagnets of the control valve to de-energize the electromagnets when the control signals from the first and second signal transmitters coincide.

* * * * *